US008090128B2

(12) United States Patent
Puder

(10) Patent No.: US 8,090,128 B2
(45) Date of Patent: Jan. 3, 2012

(54) METHOD FOR REDUCING INTERFERENCE POWERS AND CORRESPONDING ACOUSTIC SYSTEM

(75) Inventor: Henning Puder, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1028 days.

(21) Appl. No.: 12/008,689

(22) Filed: Jan. 11, 2008

(65) Prior Publication Data

US 2009/0129608 A1 May 21, 2009

Related U.S. Application Data

(60) Provisional application No. 60/879,858, filed on Jan. 11, 2007.

(51) Int. Cl.
*H04R 25/00* (2006.01)

(52) U.S. Cl. ..... 381/321; 381/92

(58) Field of Classification Search ..... 381/321, 381/92

See application file for complete search history.

(56) References Cited

U.S. PATENT DOCUMENTS

| | | | | |
|---|---|---|---|---|
| 4,536,887 | A | 8/1985 | Kaneda et al. | |
| 5,793,875 | A | 8/1998 | Lehr et al. | |
| 6,101,258 | A * | 8/2000 | Killion et al. | 381/321 |
| 6,424,721 | B1 | 7/2002 | Hohn | |
| 7,181,033 | B2 | 2/2007 | Fischer et al. | |
| 7,447,325 | B2 * | 11/2008 | Bren et al. | 381/331 |
| 2003/0072465 | A1 | 4/2003 | Fischer et al. | |
| 2006/0104459 | A1 | 5/2006 | Fischer et al. | |

FOREIGN PATENT DOCUMENTS

| | | | |
|---|---|---|---|
| DE | 19810043 | A1 | 9/1999 |
| DE | 102004052912 | A1 | 5/2006 |
| EP | 1307072 | A2 | 5/2003 |
| EP | 1653768 | A2 | 5/2006 |
| JP | 06292293 | A | 10/1994 |
| WO | 9740645 | A1 | 10/1997 |

OTHER PUBLICATIONS

Jens Meyer, Gary Elko; A Highly Scalable Spherical Microphone Array Based on an Orthonormal Decomposition of the Soundfield; mh acoustics, USA; 0-7803-7402-9/02/$17,00 EIII II-1781-II 1784; 2002.

* cited by examiner

*Primary Examiner* — Theresa T Doan

(57) ABSTRACT

The object is to improve the action of a directional microphone in real acoustic environments. To do this, it is envisaged that the interference powers in a directional microphone with three microphones are reduced in that a first and a second microphone signal are adaptively filtered with respect to a first direction, with a direction-determining first parameter being adapted in such a way that the summation of interference powers is reduced. The second and a third microphone signal is adaptively filtered with respect to the first direction, with a direction-determining second parameter being adapted in such a way that the summation of interference powers is reduced. The two parameters are different from each other. This makes it possible, even in real environments, to suppress two interference sources from different directions with one second-order directional microphone.

7 Claims, 4 Drawing Sheets

METHOD FOR REDUCING INTERFERENCE POWERS AND CORRESPONDING ACOUSTIC SYSTEM

CROSS REFERENCE TO RELATED APPLICATIONS

The present application claims the benefit of the provisional patent application filed on Jan. 11, 2007, and assigned application No. 60/879,858. The present application also claims priority of German application No. 10 2007 001 642.7 filed on Jan. 11, 2007. Both of the applications are incorporated by reference herein in their entirety.

FIELD OF THE INVENTION

The present invention relates to a method for reducing interference powers The present invention also relates to a corresponding acoustic system with a directional microphone. In particular, the present invention is directed toward a hearing aid.

BACKGROUND OF THE INVENTION

Hearing aids are portable hearing devices provided to people with impaired hearing. In order to accommodate the numerous individual requirements, different designs of hearing aids are provided, such as, for example, behind-the-ear-hearing aids (BTEs) and in-the-ear-hearing aids (ITEs), for example concha-hearing aids. The hearing aids described by way of example are worn on the outer ear or in the auditory canal. In addition, also available on the market are bone conduction hearing aids, implantable or vibrotactile hearing aids. In such cases, the damaged hearing is stimulated either mechanically or electrically.

In principle, hearing aids have the following essential components: an input transducer, an amplifier and an output transducer. The input transducer is generally a sound pickup, for example a microphone, and/or an electromagnetic receiver, for example an induction coil. The output transducer is generally implemented as an electroacoustic transducer, for example a miniature loudspeaker, or as an electromechanical transducer, for example a bone conduction hearing aid. The amplifier is usually integrated in a signal processing unit. This basic structure is shown in FIG. 1 using the example of a behind-the-ear hearing aid. One or more microphones 2 to pick up the sound from the environment are integrated in a hearing aid housing 1 for wearing behind the ear. A signal processing unit 3, which is also integrated in the hearing aid housing 1 processes and amplifies the microphone signals. The output signal from the signal processing unit 3 is transmitted to a loud speaker or receiver 4, which issues an acoustic signal. The sound may optionally be transmitted via an acoustic tube, which is fixed in the auditory canal with an otoplastic, to the eardrum of the person wearing the device. The power supply for the hearing aid and in particular for the signal processing unit 3 is provided by a battery 5 which is also integrated in the hearing aid housing 1.

People with impaired hearing suffer massively from interference signals which superimpose the useful signal. Previous approaches for real arrangements (hearing-aid directional microphone on the head) for frequencies below 1.5 to 2 kHz reveal a restricted directional effect. In particular, it has been found to be not really feasible simultaneously to suppress signals from two directions.

Known from the post-published document DE 10 2004 052912 is a method for reducing interference powers in a directional microphone and a corresponding acoustic system. The method relates inter alia to a three-microphone arrangement. A differential directional microphone formed therefrom is adjusted so that two directional interference sources can be suppressed. In addition, the directional effect is selected so that the summation of interference powers (microphone noise and external interference sources) is minimized.

FIG. 1 is a schematic representation of a known second-order differential directional microphone of this kind. This is formed from three adaptive, first-order differential directional microphones DM1, DM2 and DM3. Three microphones M1, M2 and M3 receive a time-dependent acoustic signal s(t). In the first differential microphone DM1, a microphone noise signal n1(t) and/or n2(t) is added in each instance to the ideal microphone signals. The respective summation signals are digitized with an analog-digital converter A/D thereby resulting in microphone signals $x_1(k)$ and $x_2(k)$. The first order differential microphone DM1 subtracts the two microphone signals $x_1(k)$ and $x_2(k)$ in a crosswise fashion, as is known for directional microphones. During this, the signals are delayed in the corresponding paths with timing elements T and a difference signal is multiplied by an adaptation parameter a. The resulting signals are added to obtain a first intermediate signal $z_1(k)$.

The output signal from the third microphone M3 is also subject to interference from microphone noise n3(t) and the corresponding summation signal is digitally converted into a microphone output signal $x_3(k)$. The differential microphone DM2 processes the microphone signals $x_2(k)$ and $x_3(k)$ to form a second intermediate signal $z_2(k)$ and the first differential microphone DM1 processes the two signals $x_1(k)$ and $x_2(k)$ to form the intermediate signal $z_1(k)$. The adaptation in the second differential microphone DM2 is performed with the same adaptation parameter a as in the first differential microphone DM1. In the first directional microphone stage with the two differential microphones DM1 and DM2, therefore, only one signal weighting with the signal factor a takes place.

In a similar way, the intermediate signals $z_1(k)$ and $z_2(k)$ are processed in the differential microphone DM3 to produce an output signal y(k), with a signal weighting with the factor b taking place in this second stage. In order finally to obtain the output signal y(k), firstly an equalization in the useful signal direction is performed by an equalizer EQ0 with the transmission function $$H(z) = \frac{1}{1 - 2z^{-2} + z^{-4}}.$$

Preferably, the equalization takes place in the 0° direction.

Therefore, according to the principle shown, with the second-order directional microphone, in the first stage, attenuation takes place in a first direction (defined by the parameter a) and in the second stage, attenuation takes place in a second direction (defined by the parameter b). As mentioned above, this second-order directional microphone only achieves a limited directional effect for frequencies below 1.5 to 2 kHz.

Known from publication EP 1 307 072 A2 is a method for operating a hearing aid in which disturbing acoustic effects caused by turn-on, turn-off or switching events are to be avoided. For this, a first operating condition in the hearing aid undergoes a sliding transition to a second operating condition. The sliding transition occurs by means of parallel signal processing in two signal paths, with one signal resulting from a first operating condition and one signal resulting from the second operating condition being added in alternate weighting.

Also known from the article by Meyer, J. et al, "A highly scalable spherical microphone array based on an orthonormal decomposition of the sound field, mh acoustics", pages II-1781 to II-1784, IEEE 2002, is a two-stage beam former. For this, the input signal is first split into spatially orthonormal components. The components are then multiplied with certain coefficients in order to control the direction of the directional microphone.

SUMMARY OF THE INVENTION

The object of the present invention consists in improving the action of a directional microphone and proposing a corresponding method or an acoustic system for this.

According to the invention, this object is achieved by a method for reducing interference powers in a directional microphone by the provision of at least one first, one second and one third microphone signal, first adaptive filtering of the first and second microphone signals with respect to a first direction, with a direction-determining first parameter being adapted in such a way that the summation of interference powers is reduced, and second adaptive filtering of the second and third microphone signals with respect to the first direction, with a direction-determining second parameter being adapted in such a way that the summation of interference powers is reduced, and with the first parameter being different from the second parameter.

In addition, also provided according to the invention is an acoustic system with a directional microphone comprising at least three microphones for supplying a first, a second and a third microphone signal, a first filter device for the adaptive filtering of the first and second microphone signals with respect to a first direction, with a direction-determining first parameter being adaptable in such a way that the summation of interference powers is reduced and a second filter device for the adaptive filtering of the second and third microphone signals with respect to the first direction, with a direction-determining second parameter being adaptable in such a way that the summation of interference powers is reduced, and with the first parameter of the first filter device being different from the second parameter of the second filter device.

In an advantageous way, each filter can be individually adjusted even if only one direction is to be attenuated. This enables better account to be taken of the real acoustic environments.

According to a first embodiment, the first parameter and the second parameter are independent of each other. This enables the attenuations of two parallel first-order filters to be selected entirely freely.

According to a second exemplary embodiment, the first parameter and the second parameter are linked to each other by an adjustable third parameter. In particular, the third parameter can represent the difference or double difference between the first and second parameters. This interdependence of the parameters generally enables non-convergence of the adaptation method to be avoided.

To establish a second-order directional microphone, the first and second filtering can each be performed by a first-order filter, with the filter output signals of the two filters being supplied to a third first-order filter for filtering with respect to a second direction. This enables the achievement of higher quality directional effect.

In addition, the filtering can take place separately in a number of sub-bands. In this way, the summation of interference powers can be reduced even more selectively.

Preferably, the acoustic system is a hearing aid equipped with a corresponding directional microphone. In a particularly advantageous way, reducing the interference powers enables inter alia the speech intelligibility to be significantly increased.

BRIEF DESCRIPTION OF THE DRAWINGS

The present invention will now be explained in more detail with reference to the attached drawings which show.

DETAILED DESCRIPTION OF THE INVENTION

The following exemplary embodiments described in more detail below represent preferred embodiments of the present invention.

Figure 1:
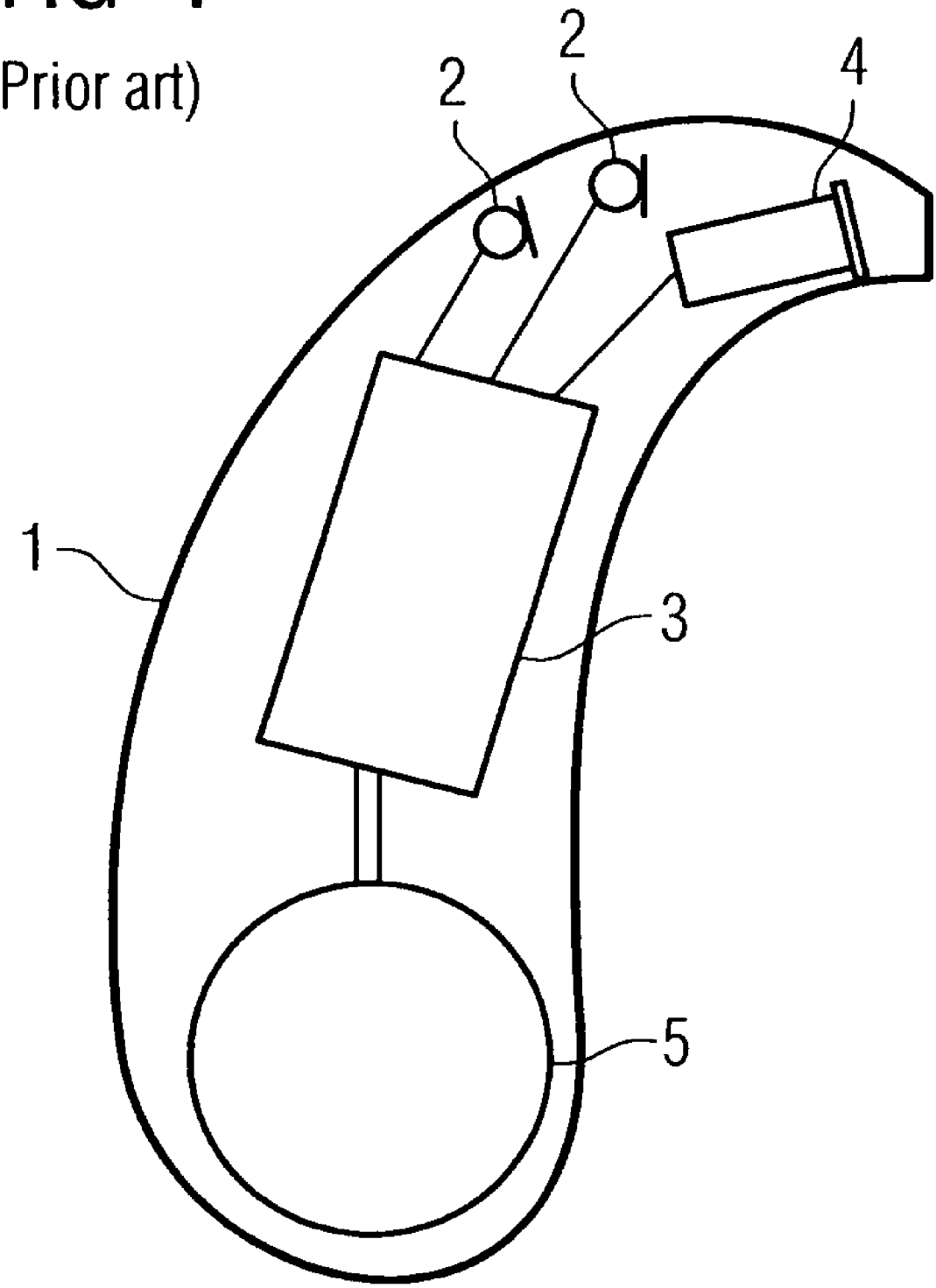
FIG 1 (Prior art)
FIG. 1 the basic structure of a hearing aid
Figure 2:
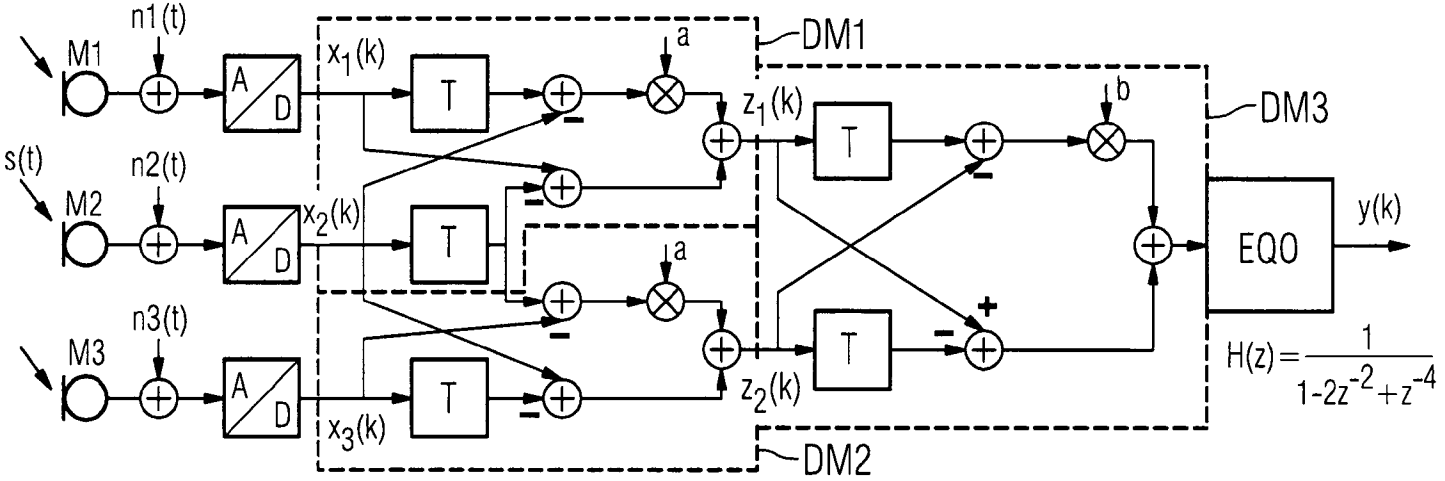
FIG 2 (Prior art)
FIG. 2 a second-order directional microphone conforming to the prior art
Figure 3:
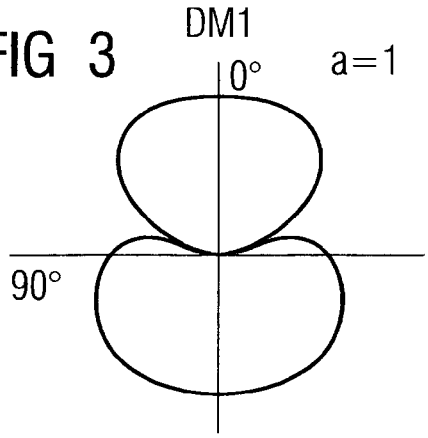
FIG. 3 a directional diagram of the differential microphone DM1 shown in FIG. 2
Figure 4:
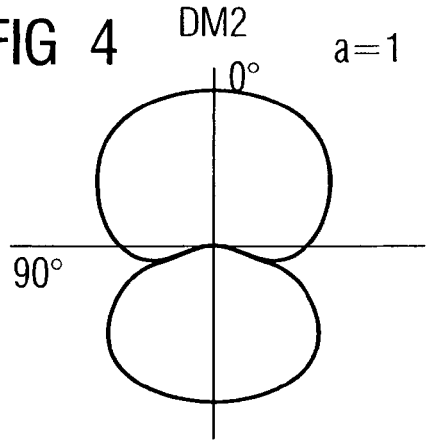
FIG. 4 a directional diagram of the differential microphone DM2 shown in FIG. 2

In measurements with real recordings with hearing aids on the KEMAR and the heads of test subjects reveals that the directional effect of the second-order directional microphone according to FIG. 2 is restricted below approximately 2 kHz. In particular, generally only one direction forms from which interference signals are to be attenuated. This can be explained with reference to FIGS. 3 to 5. For example, FIG. 3 shows the directional diagram of the first differential microphone DM1 of the known directional microphone in FIG. 2. In the selected example, the adaptation parameter of the differential first-order microphone is a=1. Due to the geometric arrangement of the microphones M1 and M2, the value of the angle of the greatest attenuation is slightly under 90°. FIG. 4 shows the corresponding directional diagram for the differential microphone DM2 in FIG. 2. Once again a=1 is specified for the adaptation parameter here. Due to the geometric arrangement of the microphones M2 and M3, in the selected example this results in a maximum attenuation in a direction with an angle slightly greater than 90°.

Figure 5:
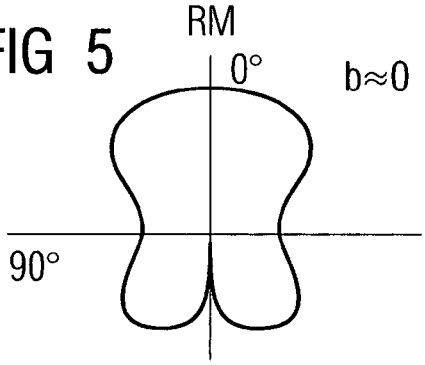
FIG. 5 a directional diagram of the second-order directional microphone shown in FIG. 2

The third first-order differential microphone DM3 of the second-order directional microphone in FIG. 2, for which the adaptation parameter b≈0 has been selected, results in a maximum attenuation at an angle of 180°. Overall, the directional diagram in FIG. 5 is then obtained for the second-order directional microphone in FIG. 2. According to this, attenuation takes place substantially from the 180° direction, while the 90° direction and the −90° direction are only slightly attenuated. This low attenuation in the +/−90° direction is the result of the fact that, with two differential microphones DM1 and DM2, the adaptation parameter a is selected the same. Consequently, in real environments slightly different values of the adaptation parameter of the differential microphones or filters are necessary to attenuate signals from the same direction with the two arrangements. On the other hand, if the same parameter a is "enforced" in two differential microphones DM1 and DM2, the attenuation of the interference from the desired direction is degraded and the attenuation is further degraded by the subsequent, third, differential microphone DM3.

According to a first embodiment of the present invention, therefore, it is envisaged that, instead of one adaptation parameter a, two different parameters $a_1$ and $a_2$ will be selected. Therefore, the known matrix from publication DE 10 2004 052912 mentioned above $$\begin{pmatrix} 1 & a+b & ab \\ -(a+b) & -2(1+ab) & -(a+b) \\ ab & a+b & 1 \end{pmatrix}$$

would produce the matrix $$\begin{pmatrix} 1 & a_1+b & a_1b \\ -(a_1+b) & -(2+a_1b+a_2b) & -(a_2+b) \\ a_2b & a_2+b & 1 \end{pmatrix}$$

Here, $a_1$ represents the adaptation parameter of the differential microphone DM1, $a_2$ represents the adaptation parameter of the differential microphone DM2 and b represents the adaptation parameter of the differential microphone DM3. If an adaptation rule for the parameters $a_1$, $a_2$ and b is developed from the last-mentioned matrix, however, it is found that this does not result in, or does not always result in, a convergent adaptation method. Adaptation methods tend to select $a_1$ and $a_2$ in such a way that the corresponding directional microphones attempt to extinguish sounds from different directions. An automatic adaptation method is not possible with common methods if the two parameters $a_1$ and $a_2$ are completely independent of each other.

Figure 6:
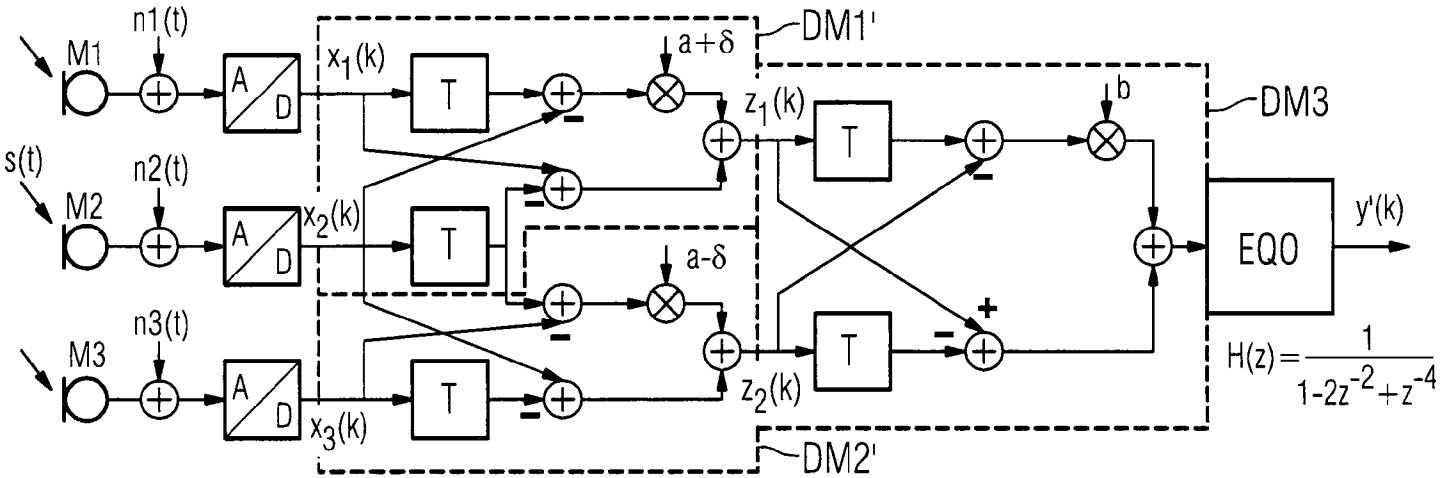
FIG. 6 a second-order directional microphone according to a second exemplary embodiment of the present invention FIG. 7 a directional diagram of the differential microphone DM1' shown in FIG. 6

According to a second exemplary embodiment, the two adaptation parameters a1 and a2 are dependent upon each other via a third parameter δ. In the following example, this dependence is structured as follows: $a_1=a+\delta$ and $a_2=a-\delta$. The corresponding second-order directional microphone is shown in FIG. 6. In principle, the structure of the directional microphone corresponds to that of the directional microphone in FIG. 2. The only difference consists in the fact that the differential microphones DM1' and DM2' have the adaptation parameters a+δ or a−δ so that the intermediate signals $z_1'(k)$ and $z_2'(k)$ and consequently the output signal y'(k) result.

This parameterization of the second-order directional microphone results in the following modified "δ-MBAT matrix" for the linking of the signals:

$$\begin{pmatrix} 1 & (a+\delta)+b & (a+\delta)b \\ -(a+\delta+b) & -(2+(a+\delta)b+(a-\delta)b) & -(a-\delta+b) \\ (a-\delta)b & (a-\delta)+b & 1 \end{pmatrix}$$

Figure 7:
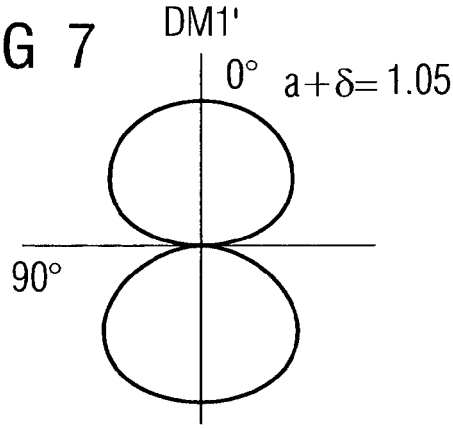
Figure 8:
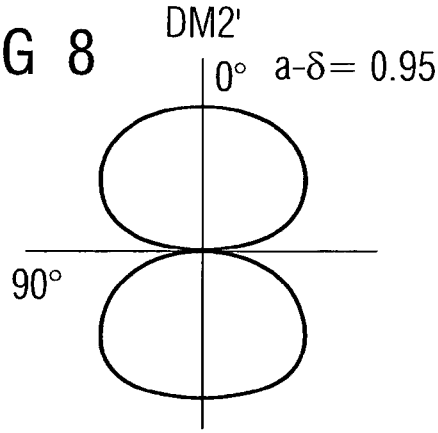
FIG. 8 a directional diagram of the differential microphone DM2' shown in FIG. 6
Figure 9:
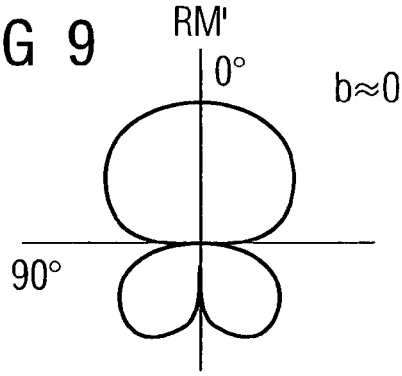
FIG. 9 a directional diagram of the second-order directional microphone shown in FIG. 6 and FIG. 10 an attenuation diagram depicting the difference between the two directional microphones shown in FIG. 2 and FIG. 6.

Via the derivation according to the three parameters a, b and δ, adaptation rules can be developed for these parameters similarly to the known adaptation rules from the above-mentioned document. In particular, the variation parameter δ e.g. maximum/minimum+/−0.2) can be used to ensure that the two directional microphones in the first stage DM1' and DM2' suppress interference from the same direction. This is elucidated by FIGS. 7 and 8. These show the two directional diagrams for the microphones for which the adaptation parameter a was varied by δ. Despite the special acoustic environment, for two microphones DM1' and DM2', maximum attenuation is attained in the 90° direction desired here. Subsequent further filtering in the second stage by the differential microphone DM3 with the adaptation parameter b≈0 produces for the entire directional microphone RM', which is shown in FIG. 6, the directional diagram according to FIG. 9. The attenuation in the direction desired by the filtering in the first stage (+/−90°) is also retained by the second stage which only adds attenuation in the second direction (here 180°).

Figure 10:
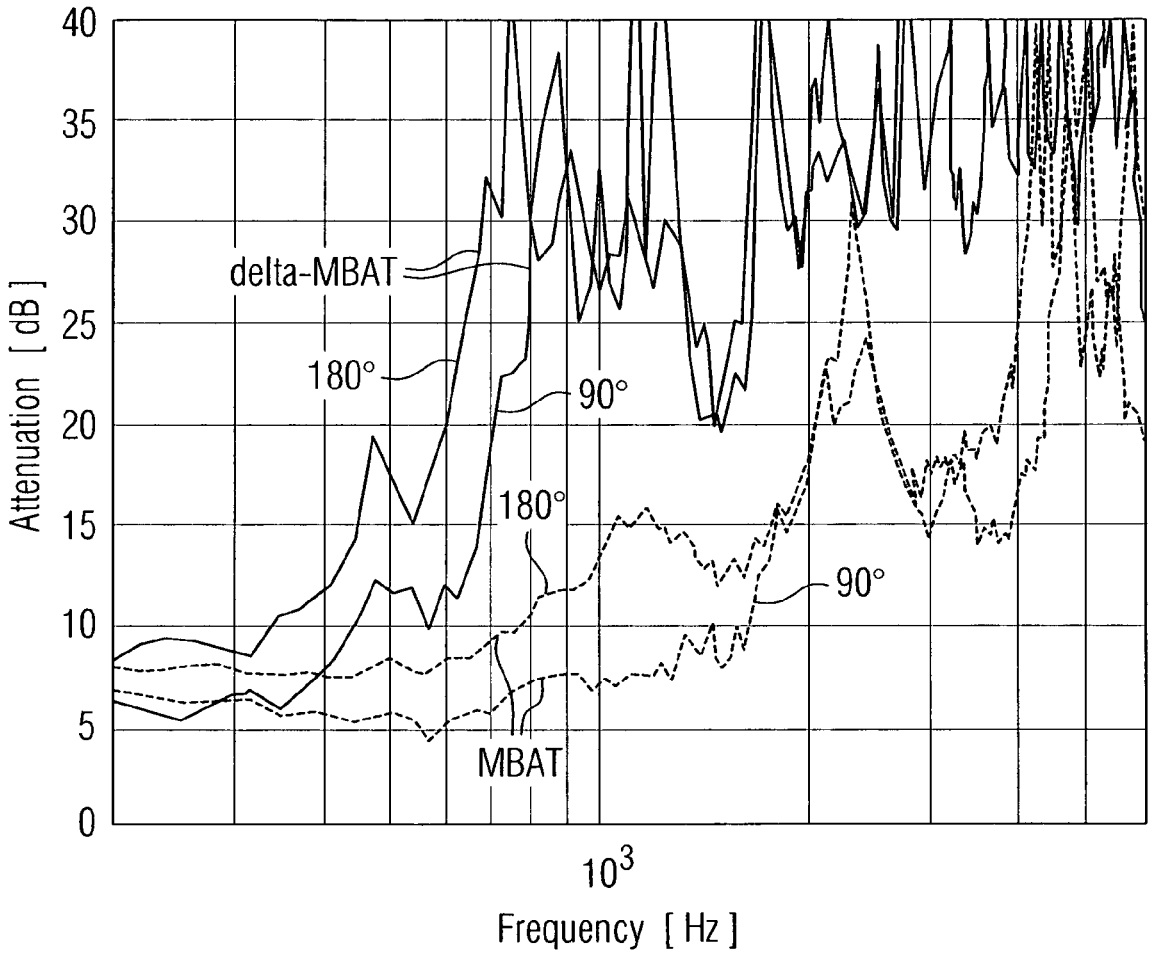

The directional diagrams shown in FIGS. 3 to 5 and 7 to 9 relate to a special frequency. In principle, attenuation by directional microphones is namely frequency-dependent. It has been found that a directional microphone according to the approach in FIG. 6 also displays clear attenuation for acoustic signals from 500 Hz upward. This is shown in FIG. 10 for the two angles 90° and 180°. With the known MBAT approach, clear attenuation only takes place from approximately 2 kHz. This applies to interference from both the 90° and the 180° direction (compare the dotted lines in FIG. 10). Therefore, this produces a clear improvement in the suppression of interference in real environments. In particular, in this way it is possible to suppress two interference sources from different directions with a second-order directional microphone in real environments.

The invention claimed is:

1. A method for reducing interference powers in a directional microphone, comprising:

providing at least a first microphone signal, a second microphone signal, and a third microphone signal;

adaptively first filtering the first and the second microphone signals with respect to a first direction;

adapting a direction-determining first parameter for reducing the interference powers;

adaptively second filtering the second and the third microphone signals relative to the first direction; and adapting a direction-determining second parameter for reducing the interference powers, the second parameter being different from the first parameter.

2. The method as claimed in claim 1, wherein the first and the second parameters are independent of each other.

3. The method as claimed in claim 1, wherein the first and the second parameters are linked to each other by a third parameter.

4. The method as claimed in claim 3, wherein the third parameter is a difference between the first and the second parameters or double the difference between the first and the second parameters.

5. The method as claimed in claim 1, wherein the first filtering is performed by a first first-order filter and the second filtering is performed by a second first-order filter.

6. The method as claimed in claim 5, wherein the first and the second first-order filters output signals to a third first-order filter for filtering the at least three microphone signals with respect to a second direction to achieve a second order filtering.

7. The method as claimed in claim 1, wherein the first filtering and the second filtering are performed separately in a plurality of sub-bands.

* * * * *